US010870942B2

(12) United States Patent
Kwon et al.

(10) Patent No.: US 10,870,942 B2
(45) Date of Patent: Dec. 22, 2020

(54) WASHING MACHINE

(71) Applicant: Samsung Electronics Co., Ltd., Suwon-si (KR)

(72) Inventors: Baek Gyu Kwon, Suwon-si (KR); Dong-Won Kim, Suwon-si (KR); Do Yun Lee, Yongin-si (KR); Bo-Kyun Kim, Suwon-si (KR); Geon Ho Lee, Incheon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 341 days.

(21) Appl. No.: 15/827,148

(22) Filed: Nov. 30, 2017

(65) Prior Publication Data

US 2018/0179685 A1 Jun. 28, 2018

(30) Foreign Application Priority Data

Dec. 23, 2016 (KR) ..... 10-2016-0178591

(51) Int. Cl.

| | |
|---|---|
| ***D06F 37/20*** | (2006.01) |
| ***D06F 39/12*** | (2006.01) |
| ***D06F 21/04*** | (2006.01) |
| ***D06F 21/08*** | (2006.01) |
| ***D06F 37/26*** | (2006.01) |
| *D06F 31/00* | (2006.01) |

(52) U.S. Cl.

CPC ..... *D06F 37/20* (2013.01); *D06F 21/04* (2013.01); *D06F 21/08* (2013.01); *D06F 37/26* (2013.01); *D06F 39/12* (2013.01); *D06F 31/00* (2013.01)

(58) Field of Classification Search

None

See application file for complete search history.

(56) References Cited

U.S. PATENT DOCUMENTS

| | | | | |
|---|---|---|---|---|
| 2009/0145176 | A1* | 6/2009 | Kim | D06F 39/125 68/27 |
| 2009/0145177 | A1 | 6/2009 | Kim et al. | |
| 2011/0041560 | A1 | 2/2011 | Lee et al. | |
| 2011/0241501 | A1 | 10/2011 | Heo | |
| 2015/0135777 | A1 | 5/2015 | Cho | |
| 2016/0215432 | A1 | 7/2016 | Kim | |

FOREIGN PATENT DOCUMENTS

| | | | |
|---|---|---|---|
| CN | 204690361 | 10/2015 | |
| CN | 105624993 | 6/2016 | |
| CN | 105937122 | 9/2016 | |
| CN | 106149276 | 11/2016 | |
| CN | 106149276 A * | 11/2016 | D06F 31/00 |

(Continued)

OTHER PUBLICATIONS

English machine translation of CN106149276A.*

(Continued)

*Primary Examiner* — Levon J Shahinian
*Assistant Examiner* — Jason P Riggleman
(74) *Attorney, Agent, or Firm* — Staas and Halsey LLP

(57) ABSTRACT

A washing machine including a plurality of washers may include a fixing bracket coupled to a front of a first housing in which a first tub is disposed and a front of a second housing in which a second tub is disposed, to prevent the first housing and the second housing from being separated from each other.

20 Claims, 7 Drawing Sheets

(56) References Cited

FOREIGN PATENT DOCUMENTS

| | | |
|---|---|---|
| EP | 1550756 | 7/2005 |
| KR | 10-2008-0096301 | 10/2008 |
| KR | 10-1387483 | * 10/2008 |
| KR | 10-1387483 | 4/2014 |
| WO | 2016/155801 | 10/2016 |
| WO | 2016/173565 | 11/2016 |

OTHER PUBLICATIONS

Extended European Search Report dated Mar. 27, 2018 in European Patent Application No. 17204438.0.
International Search Report dated Mar. 13, 2018 in International Patent Application No. PCT/KR2017/014012.
European Communication Under Rule 71(3) dated Nov. 15, 2018 in European Patent Application No. 17204438.0.
Extended European Search Report dated May 2, 2019 in European Patent Application No. 19164593.6.
Chinese Office Action dated Nov. 6, 2019 in Chinese Patent Application No. 201711381043.9.
Indian Office Action dated Jul. 29, 2020 in Indian Patent Application No. 201917029071.
Chinese Office Action dated Jul. 15, 2020 in Chinese Patent Application No. 201711381043.9.

* cited by examiner

WASHING MACHINE

CROSS-REFERENCE TO RELATED APPLICATIONS

This application claims the priority benefit of Korean Patent Application No. 10-2016-0178591, filed on Dec. 23, 2016 in the Korean Intellectual Property Office, the disclosure of which is incorporated herein by reference.

BACKGROUND

1. Field

The following description relates to a washing machine, and more particularly, to a washing machine including a plurality of washers.

2. Description of the Related Art

Generally, a washing machine is an apparatus which washes laundry by rotating a cylindrical rotating tub in which the laundry is accommodated. Washing machines include a washing machine which washes laundry by horizontally disposing a rotating tub such that laundry is lifted upward along an inner circumference of the rotating tub and falls down when the rotating tub rotates on a horizontal axis and a washing machine in which a rotating tub including a pulsator is vertically disposed and which washes laundry using water currents generated by the pulsator when the rotating tub rotates on a perpendicular axis.

The washing machine including the horizontally disposed rotating tub is referred to as a front-loading washing machine due to a laundry insertion hole formed at a front thereof. The washing machine including the vertically disposed rotating tub is referred to as a top-loading washing machine due to a laundry insertion hole formed at a top thereof.

Meanwhile, because a general washing machine has a single washer, a user should operate the washing machine two or more times when the user wants to separate and wash laundry. Accordingly, even though there is a relatively small amount of laundry, the user should operate the washing machine for a long time.

SUMMARY

Therefore, it is an aspect of the present disclosure to provide a washing machine including a plurality of washers.

It is an aspect of the present disclosure to provide a washing machine including an improved coupling structure between a first housing in which a first tub is disposed and a second housing in which a second tub is disposed.

Additional aspects of the present disclosure will be set forth in part in the description which follows and, in part, will be obvious from the description, or may be learned by practice of the present disclosure.

In accordance with one aspect of the present disclosure, a washing machine includes a first housing in which a first tub is disposed and which includes an open top, a second housing in which a second tub is disposed and which includes an open bottom, and a fixing bracket coupled to a front of the first housing and a front of the second housing. Here, the first housing includes a pair of first side panels which form side surfaces of the first housing. The second housing includes a pair of second side panels which form side surfaces of the second housing. The fixing bracket connects the pair of first side panels to the pair of second side panels.

The first tub may include an opening for inserting laundry, at a front thereof, and the second tub may include an opening for inserting laundry, at a top thereof.

The second housing may include a lower frame to which the second tub is supported and an upper frame disposed on the lower frame.

The second housing may further include a side cover provided to cover a side surface of the upper frame and a side surface of the lower frame.

The washing machine may further include a suspending device which supports the second tub toward the lower frame.

The lower frame may include a first supporter formed in a shape in which a front wall, a rear wall, and a pair of side walls are connected to surround a front, a rear, and sides of the second tub and provided to hold the suspending device at a top end of each corner.

The second tub may include a second supporter on which the suspending device is mountable, at a bottom of an outer surface, and the suspending device may be configured to connect the first supporter to the second supporter.

The washing machine may further include a guide protrusion which protrudes upward from the pair of first side panels and a guide protrusion insertion portion disposed in bottoms of the pair of second side panels to insert the guide protrusion thereinto.

The washing machine may further include a guide protrusion which protrudes downward from the pair of second side panels and a guide protrusion insertion portion disposed in tops of the pair of first side panels to insert the guide protrusion thereinto.

The washing machine may further include a front cover provided to cover at least part of a front surface of the first housing and at least part of a front surface of the second housing.

The fixing bracket may include a guide protrusion configured to guide a coupling position of the front cover, and the front cover may include a guide hole configured to be coupled to the guide protrusion of the fixing bracket.

The fixing bracket may include a first coupler to which the front cover is fixable, and the front cover may include a second coupler which is fixable to the fixing bracket.

In accordance with one aspect of the present disclosure, a washing machine includes a first housing, a second housing disposed above the first housing, and a front cover provided to cover at least part of a front surface of the first housing and at least part of a front surface of the second housing.

The washing machine may further include a fixing bracket disposed inside the front cover and configured to couple the first housing to the second housing not to be separated from each other.

The fixing bracket may be coupled to a front of the first housing and a front of the second housing.

The washing machine may further include a tub supported to the first housing and a spring which supports the tub to the first housing. Here, the spring may be configured to connect an outer surface of the tub to a top of the first housing.

The front cover may be disposed to allow a height of a top end of the front cover is higher than a height of a top end of the first housing.

The fixing bracket may include a rectangular shape having a length corresponding to lateral widths of the first housing and the second housing and a thickness corresponding to a thickness of the front cover and may be configured to allow a rear surface and a bottom surface to be open.

The washing machine may further include a tub supported to the second housing, a drum disposed to be rotatable in the tub, and a driving motor disposed outside a bottom of the tub and configured to rotate the drum.

The fixing bracket may include a fire-resistant material and may be disposed to allow a height of a top end of the fixing bracket to be equal to or higher than a height of a top end of the driving motor.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Figure 1:
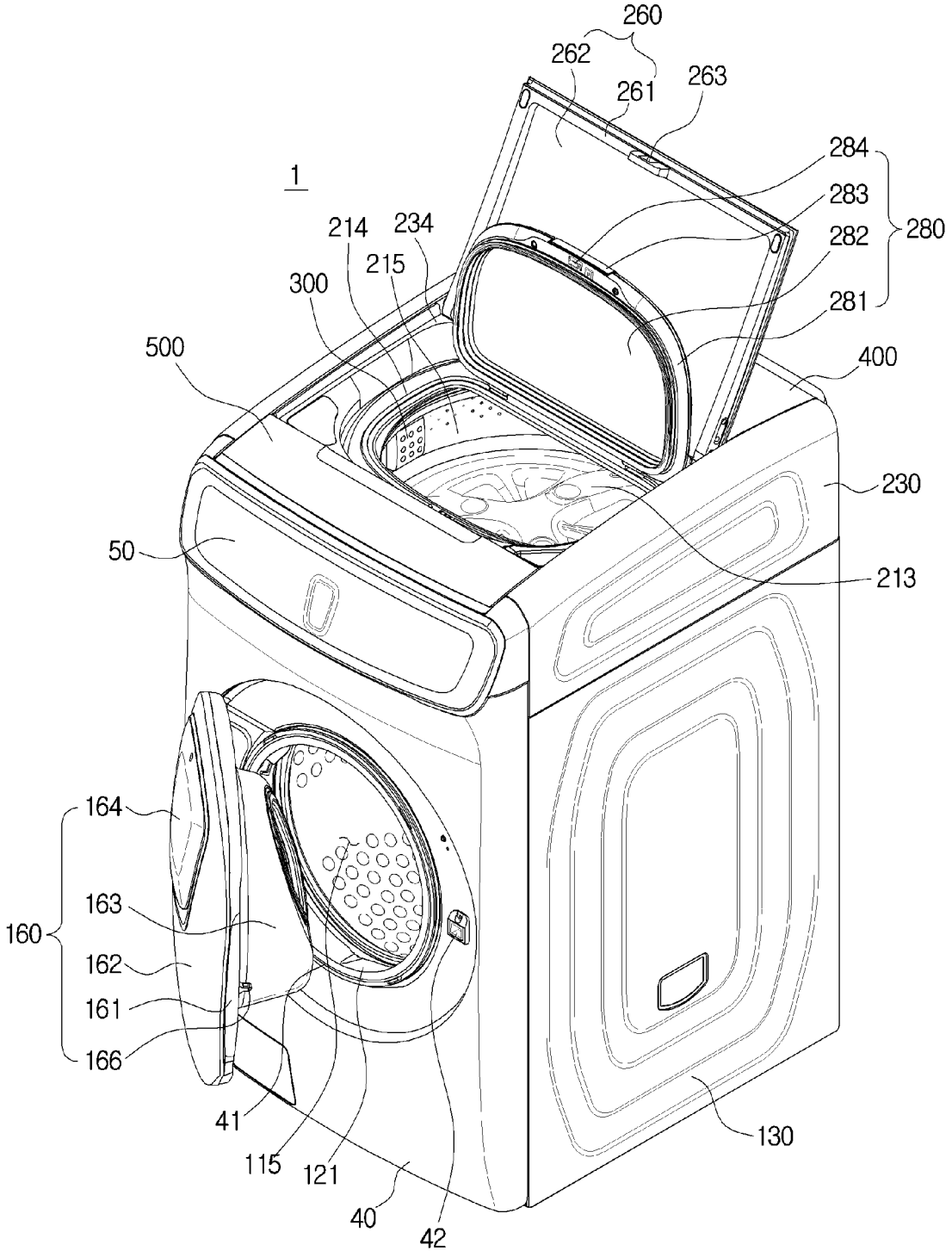
FIG. 1 is a perspective view of a washing machine according to an embodiment of the present disclosure.

Embodiments disclosed in the specification and components shown in the drawings are merely examples of the present disclosure and various modifications capable of replacing the embodiments and drawings of the specification may be made at the time of filing the present application.

Also, throughout the drawings of the present specification, like reference numerals or symbols refer to components or elements configured to perform substantially identical functions.

Also, the terms used herein are to explain the embodiments but are not intended to limit and/or define the present disclosure. Singular forms, unless defined otherwise in context, include plural forms. Throughout the specification, the terms "comprise", "have", and the like are used herein to specify the presence of stated features, numbers, steps, operations, elements, components or combinations thereof but do not preclude the presence or addition of one or more other features, numbers, steps, operations, elements, components, or combinations thereof.

Also, even though the terms including ordinals such as "first", "second", and the like may be used for describing various components, the components will not be limited by the terms and the terms are used only for distinguishing one element from others. For example, without departing from the scope of the present disclosure, a first component may be referred to as a second component, and similarly, the second component may be referred to as the first component. The term "and/or" includes any and all combinations or one of a plurality of associated listed items.

Hereinafter, the embodiments will be described in detail with reference to the attached drawings.

Figure 2:
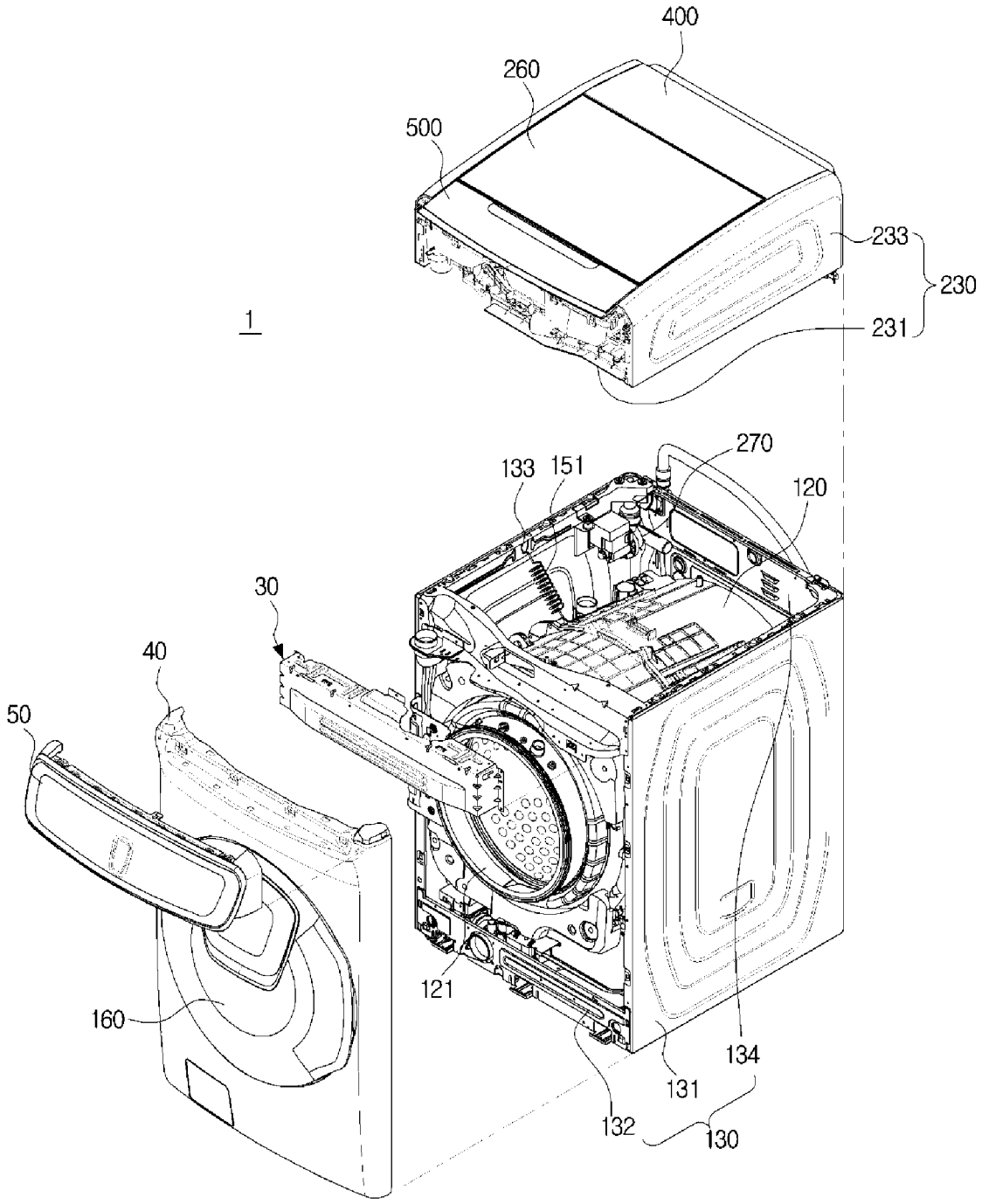
FIG. 2 is an exploded view illustrating some components of the washing machine shown in FIG. 1.
Figure 3:
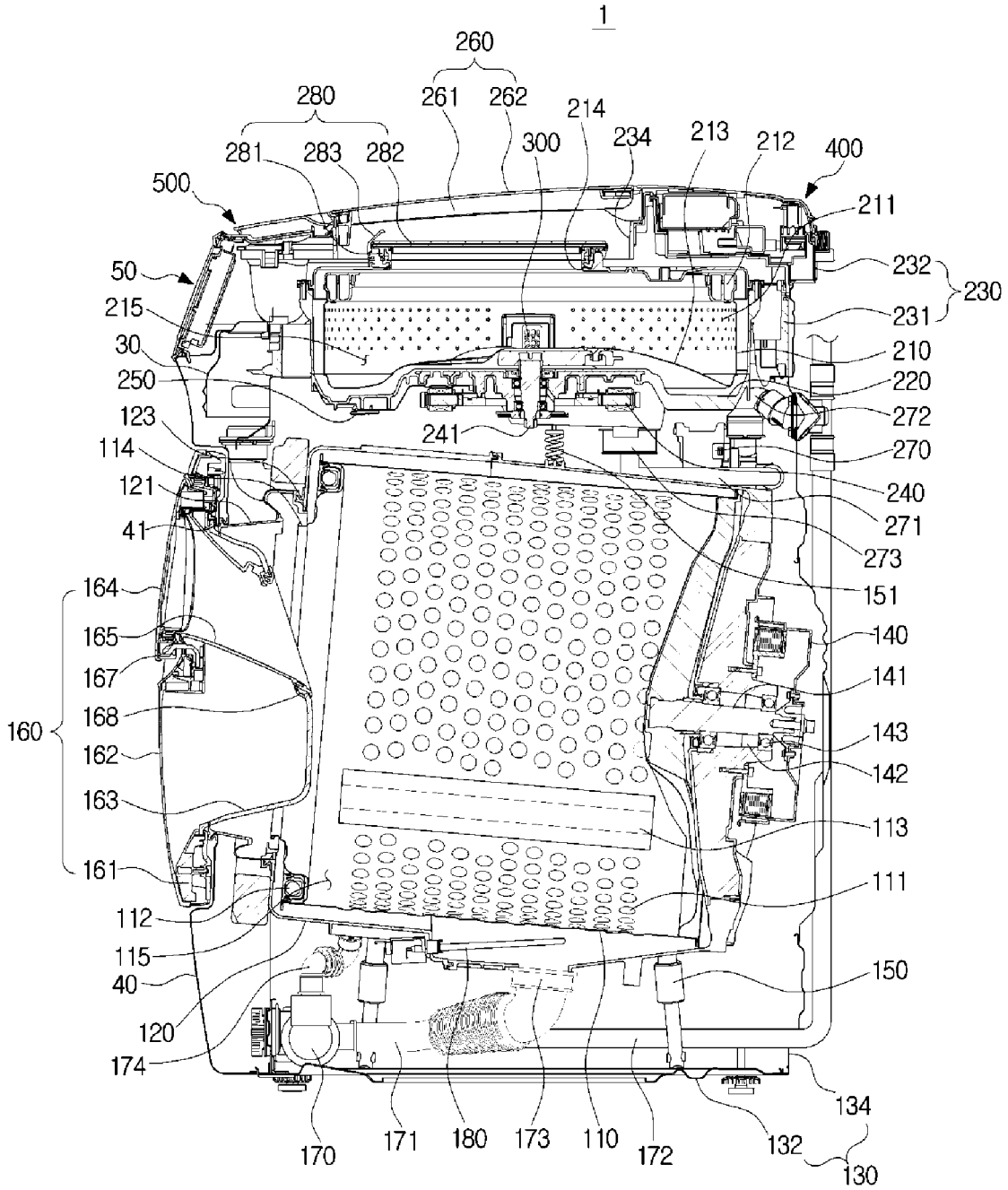
FIG. 3 is a cross-sectional view of the washing machine shown in FIG. 1.

FIG. 1 is a perspective view of a washing machine according to an embodiment of the present disclosure. FIG. 2 is an exploded view illustrating some components of the washing machine shown in FIG. 1. FIG. 3 is a cross-sectional view of the washing machine shown in FIG. 1.

As shown in FIGS. 1 to 3, a washing machine 1 may include a front-loading type first washer which includes a laundry insertion hole formed at a front of a first washing space 115 and a top-loading type second washer which includes a laundry insertion hole formed at a top of a second washing space 215.

The washing machine 1 may include a first drum 110 in which the first washing space 115 is formed and a first tub 120 which accommodates the first drum 110 and stores washing water or rinsing water to be used in a washing operation or a rinsing operation. The first drum 110 and the first tub 120 may have a cylindrical shape with at least partially opened one surface and may be disposed to allow the opened one surface to face frontward. In detail, the first drum 110 may include an opening 114 for inserting laundry at a front thereof, and the first tub 120 may include an opening 123 for inserting laundry at a front thereof.

The washing machine 1 may include a first housing 130 in which the first drum 110 and the first tub 120 are disposed. In detail, the first housing 130 with an open top may include a pair of first side panels 131 which form side surfaces of the first housing 130, a first rear panel 134 which forms a rear surface, and a bottom panel 132 which forms a bottom surface. The first side panels 131 and the first rear panel 134 may be integrated.

Also, the washing machine 1 may include a spring 151 and a damper 150, capable of supporting the first tub 120 to the first housing 130. The damper 150 may connect an outer surface of the first tub 120 to the bottom panel 132 to support the first tub 120 at a bottom thereof, and the spring 151 may connect the outer surface of the first tub 120 to spring couplers 133 provided at a top of the first side panels 131 to support the first tub 120 at a top thereof. The spring 151 and the damper 150 may buffer vibrations, noises, and shocks, which occur due to a movement of the first tub 120.

Installation positions of the spring 151 and the damper 150 are not limited to the top of the first side panels 131 and the bottom panel 132, and one surface of the first tub 120 and another part of the first housing 130 may be connected to support the first tub 120.

The washing machine 1 may include a first driving motor 140 disposed in the rear of the first tub 120 to rotate the first drum 110. A first driving shaft 141 for transmitting power of the first driving motor 140 may be connected to a rear surface of the first drum 110.

A plurality of through holes 111 for a flow of washing water may be formed at a circumference of the first drum 110. A plurality of lifters 113 may be installed at an inner circumferential surface of the first drum 110 to allow laundry to move upward and fall down when the first drum 110 rotates. A first balancer 112 may be mounted on a front of the first drum 110 to allow the first drum 110 to stably rotate during high-speed spinning.

The first driving shaft 141 may be disposed between the first drum 110 and the first driving motor 140. One end of the first driving shaft 141 is connected to a rear panel of the first drum 110, and the other end of the first driving shaft 141 is extended outward from a rear wall of the first tub 120. When the first driving motor 140 drives the first driving shaft 141, the first drum 110 connected to the first driving shaft 141 rotates around the first driving shaft 141.

A bearing housing 142 may be installed at the rear wall of the first tub 120 to rotatably support the first driving shaft 141. The bearing housing 142 may be formed of an aluminum alloy and may be inserted into the rear wall of the first tub 120 when the first tub 120 is injection-molded. Bearings 143 are installed between the bearing housing 142 and the first driving shaft 141 to allow the first driving shaft 141 to smoothly rotate.

The washing machine 1 may include a function of washing with water at high temperature. To obtain the water at high temperature, a heater 180 capable of heating washing water or rinsing water accommodated in the first tub 120 may be disposed at a bottom surface of the first tub 120.

The washing machine 1 may include a first drain pump 170 disposed below the first tub 120 to discharge water in the first tub 120 outward from the washing machine 1, a first connecting hose 171 which connects a first drain hole 173 of the first tub 120 to the first drain pump 170 to allow the water in the first tub 120 to flow into the first drain pump 170, a circulating hose 174 which connects the first drain pump 170 to the first tub 120 to circulate the water which flows into the first drain pump 170 through the first tub 120, and a first drain hose 172 which guides water pumped by the first drain pump 170 to the outside of the washing machine 1.

The washing machine 1 may include a front cover 40 at which a first insertion hole 41 for inserting laundry into the first washing space 115 is disposed, and a first door 160 for opening and closing the first insertion hole 41 may be coupled to the front cover 40.

The first door 160 may be provided corresponding to the first insertion hole 41 and may be provided to be pivotable with respect to the front cover 40. The first door 160 may include a first door frame 161, a first door cover 162, and door glass 163.

The first door frame 161 has an approximately annular shape as illustrated, but may have an approximately quadrangular shape. The first door cover 162 and the door glass 163 may be formed of transparent materials to allow an inside of the first drum 110 to be seen from the outside of the washing machine 1 even when the first door 160 closes the first insertion hole 41. The door glass 163 may be disposed to convexly protrude from the first door frame 161 toward the inside of the first drum 110. Through the configuration, the door glass 163 may be inserted into the first insertion hole 41 when the first door 160 is closed.

A first hinge (not shown) is provided near the first insertion hole 41 and coupled to a first hinge coupler (not shown) formed on one side of the first door frame 161 to allow the first door 160 to pivot with respect to the front cover 40. A first hook 166 is provided on the other side of the first door frame 161 and a first hook accommodating portion 42 is provided at the front cover 40 corresponding to the first hook 166 such that the first door 160 may remain in a state of closing the first insertion hole 41.

To insert laundry into the first washing space 115 even when the first door 160 is closed, the first door 160 may include an auxiliary laundry insertion hole 167 and an auxiliary door 164 for opening and closing the auxiliary laundry insertion hole 167. The auxiliary door 164 may be pivotably mounted on the first door cover 162.

To insert laundry into the washing machine 1 through the auxiliary laundry insertion hole 167 of the first door 160, it is necessary to allow the laundry to pass through the door glass 163. For this, the door glass 163 includes a glass through hole 168. As an alternative, it is possible to configure door glass not to be disposed in the rear of the auxiliary laundry insertion hole 167 by recessing a top of the door glass.

The first door 160 may include a connection guide 165 to connect the auxiliary laundry insertion hole 167 of the first door 160 to the glass through hole 168 of the door glass 163. The connection guide 165 may have a pipe shape with both ends open and a hollow center.

In detail, one end of the connection guide 165 is connected to the auxiliary laundry insertion hole 167, and the other end is connected to the glass through hole 168. In the embodiment, the connection guide 165 may be tilted downward from a front to a rear. That is, the one end of the connection guide 165 connected to the auxiliary laundry insertion hole 167 may be at a position higher than that of the other end thereof. Through the configuration, a user may easily insert laundry into the first drum 110 through the auxiliary laundry insertion hole 167.

The first door 160 has been described as including the auxiliary door 164 in the embodiment but is not limited thereto. The first door 160 may be configured without an auxiliary laundry insertion hole, an auxiliary door, a connection guide, and the like.

The washing machine 1 may include a diaphragm 121 disposed between the first insertion hole 41 of the front cover 40 and the opening 123 of the first tub 120. The diaphragm 121 may form a path from the first insertion hole 41 to the opening 114 of the first drum 110 and reduce vibrations transferred to the front cover 40 during rotation of the first drum 110. Also, a part of the diaphragm 121 may be disposed between the first door 160 and the front cover 40 to prevent washing water in the first tub 120 from leaking outward from the washing machine 1.

The washing machine 1 may include a second drum 210 in which the second washing space 215 is formed and a second tub 220 which accommodates the second drum 210 and stores washing water or rinsing water to be used in a washing operation or a rinsing operation. The second drum 210 and the second tub 220 may have a cylindrical shape with at least one partially opened surface and may be disposed to allow the at least one partially opened surface to face upward.

The washing machine 1 may include a second housing 230 in which the second drum 210 and the second tub 220 are disposed and which includes an open bottom. In detail, the second housing 230 may include a lower frame 231 which includes a top and an open bottom and supports the second tub 220 and an upper frame 232 which includes a second insertion hole 234 for inserting laundry into the second washing space 215 and is mounted above the lower frame 231. Also, the second housing 230 may include side covers 233 which form exteriors of a left surface and a right surface.

The washing machine 1 may include a second door 260 disposed at the second housing 230 to open and close the second insertion hole 234. The second door 260 may be provided corresponding to the second insertion hole 234 and may be provided to be pivotable with respect to the upper frame 232. The second door 260 may include a second door frame 261 and a second door cover 262. The second door cover 262 may be formed of a transparent material to allow the second tub 220 and the second drum 210 to be seen from the outside of the washing machine 1 even when the second door 260 closes the second insertion hole 234.

To allow the second door 260 to pivot with respect to the upper frame 232, second hinges (not shown) are provided at both left and right sides of the second door frame 261 and coupled to second hinge couplers (not shown) formed around the second insertion hole 234. A latch accommodating portion 263 is provided at a front of the second door frame 261 and a latch device (not shown) is provided at the upper frame 232 corresponding to the latch accommodating portion 263 of the second door frame 261 such that the second door 260 may remain in a state of closing the second insertion hole 234.

The second drum 210 may be provided to have a cylindrical shape with an open top and be disposed to be rotatable in the second tub 220. A plurality of second through holes 211 for a flow of washing water may be formed at side surfaces and a bottom surface of the second drum 210. A second balancer 212 may be mounted on a top of the second drum 210 to allow the second drum 210 to stably rotate during high-speed spinning. A filter 300 provided to filter out foreign substances which may occur during washing may be attached to an inner surface of the second drum 210.

A curve portion 213 for generating water currents may be formed at the bottom surface of the second drum 210. Although not shown in the drawings, the washing machine 1 may further include a pulsator disposed in the second drum 210 to generate water currents.

The second tub 220 may have a cylindrical shape and be supported by suspension devices 250 to the lower frame 231. In detail, the second tub 220 may be supported by four suspension devices 250 to be suspended from the lower frame 231. A third insertion hole 214 may be provided at a top surface of the second tub 220 corresponding to the second insertion hole 234, and a third door 280 for opening and closing the third insertion hole 214 may be coupled thereto.

The third door 280 may include a third door frame 281 and a third door cover 282. The third door cover 282 may be formed of a transparent material to allow an inside of the second drum 210 to be seen from an outside of the second tub 220 even when the third door 280 closes the third insertion hole 214.

A third hinge (not shown) is provided near the third insertion hole 214 and coupled to a third hinge coupler (not shown) formed at one side of the third door frame 281 to allow the third door 280 to pivot with respect to the second tub 220. A handle 283 capable of opening the third door 280 may be provided at the other side of the third door frame 281, and a second hook 284 may be provided at the handle 283. A second hook accommodating portion (not shown) is provided at the second tub 220 corresponding to the second hook 284 such that the third door 280 may remain in a state of closing the third insertion hole 214. When the handle 283 is pulled, the second hook 284 may be separated from the second hook accommodating portion and open the third door 280.

The washing machine 1 may include a second driving motor 240 disposed outside a bottom of the second tub 220 to rotate the second drum 210. A second driving shaft 241 for transmitting power of the second driving motor 240 may be connected to the bottom surface of the second drum 210. One end of the second driving shaft 241 is connected to a bottom panel of the second drum 210, and the other end of the second driving shaft 241 is extended outward from a bottom wall of the second tub 220. When the second driving motor 240 drives the second driving shaft 241, the second drum 210 connected to the second driving shaft 241 rotates around the second driving shaft 241.

Although not shown in the drawings, when the pulsator is disposed at the bottom surface of the second drum 210, the washing machine 1 may further include a power switching device to simultaneously or selectively transfer a driving force generated from the second driving motor 240 to the second drum 210 and the pulsator.

The washing machine 1 may include a second drain pump 270 disposed below the second tub 220 to discharge water in the second tub 220 to the outside of the washing machine 1 and a second drain hose 272 which guides the water pumped by the second drain pump 270 to the outside of the washing machine 1. In detail, the second drain pump 270 may be mounted above the first housing 130.

A second drain hole 273 capable of draining water in the second tub 220 may be formed at a bottom surface of the second tub 220. The second drain hole 273 and the second drain pump 270 may be connected by a second connecting hose 271 to allow the water in the second tub 220 to flow into the second drain pump 270.

The washing machine 1 may include a water supply device 400 capable of supplying washing water to the first tub 120 and the second tub 220. The water supply device 400 may be disposed at the second housing 230. In detail, the water supply device 400 may be disposed at the upper frame 232 or may be disposed in the rear of the second insertion hole 234.

Also, the washing machine 1 may include a detergent supply device 500 capable of supplying a detergent to the first tub 120. The detergent supply device 500 may be disposed at the second housing 230. In detail, the detergent supply device 500 may be disposed at the upper frame 232 or may be disposed in the front of the second insertion hole 234.

The washing machine 1 may include a fixing bracket 30 which couples the first housing 130 and the second housing 230 not to be separated. The fixing bracket 30 may be coupled to a front of the first housing 130 and a front of the second housing 230.

Also, the washing machine 1 may include a control panel 50 disposed above the front cover 40 to operate the washing machine 1. The control panel 50 may include an interface which receives an operation command of the washing machine 1 from the user and a display which displays operation information of the washing machine 1.

Figure 4:
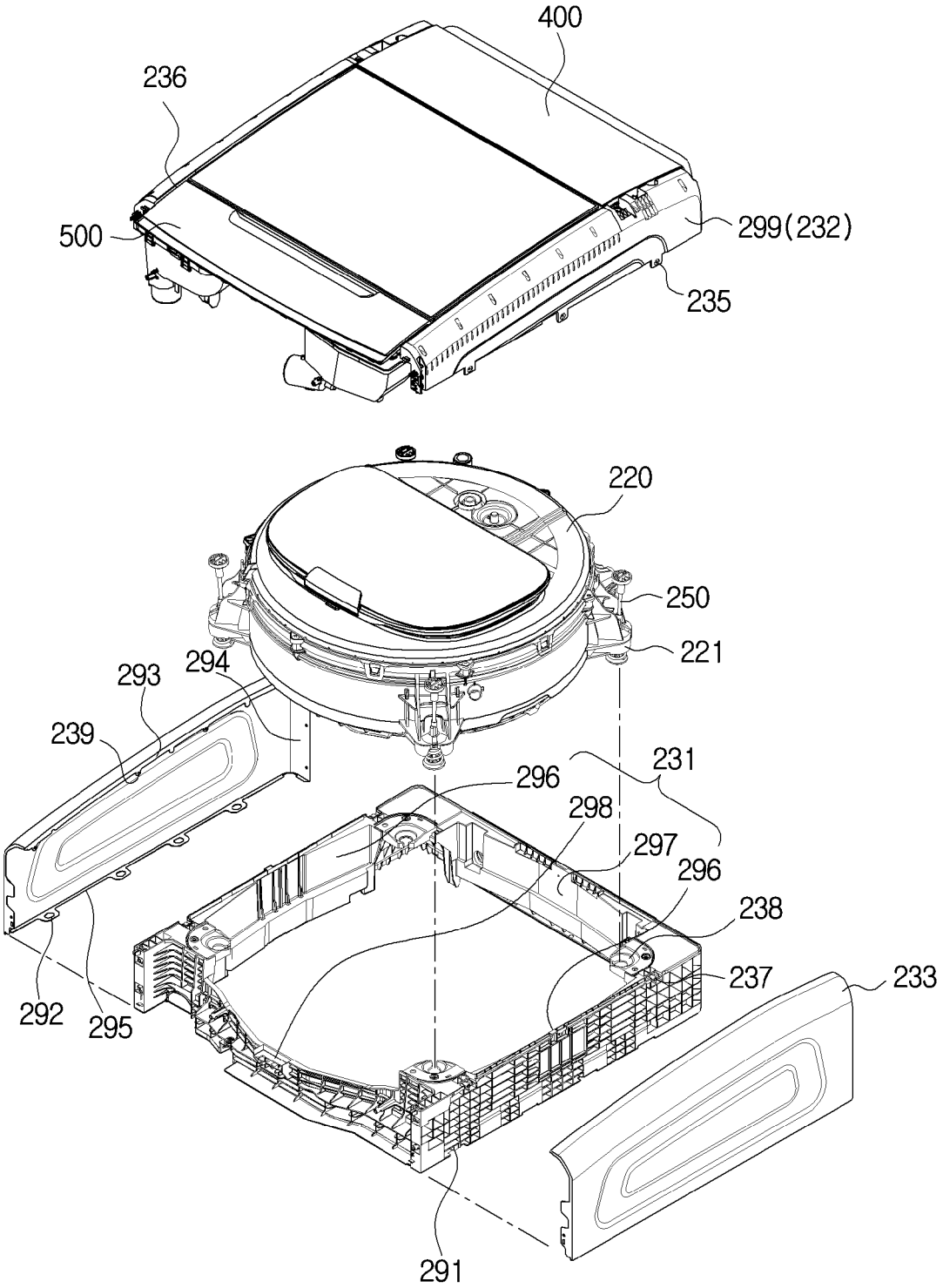
FIG. 4 is an exploded perspective view illustrating a second housing of the washing machine shown in FIG. 2.
Figure 5:
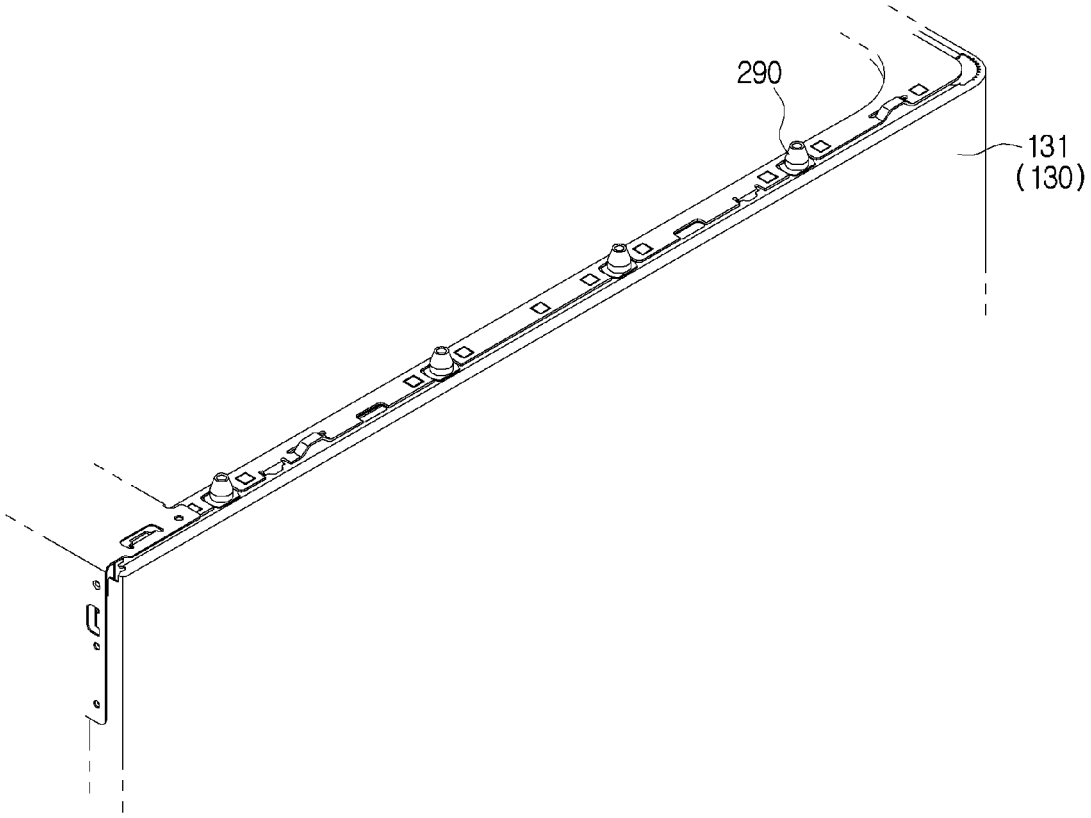
FIG. 5 is an enlarged view illustrating a part of a first housing of the washing machine shown in FIG. 2.
Figure 6:
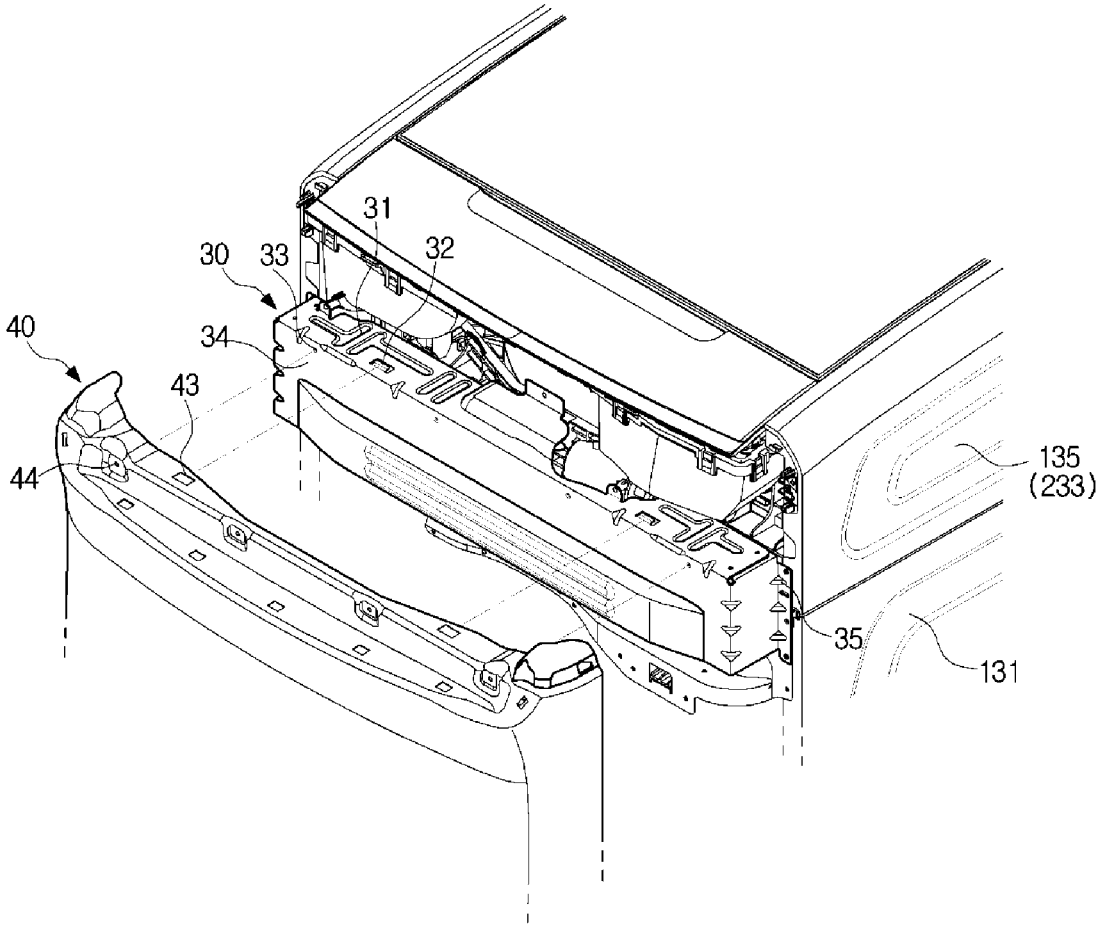
FIG. 6 is an enlarged view illustrating parts of a fixing bracket and a front cover of the washing machine shown in FIG. 2.
Figure 7:
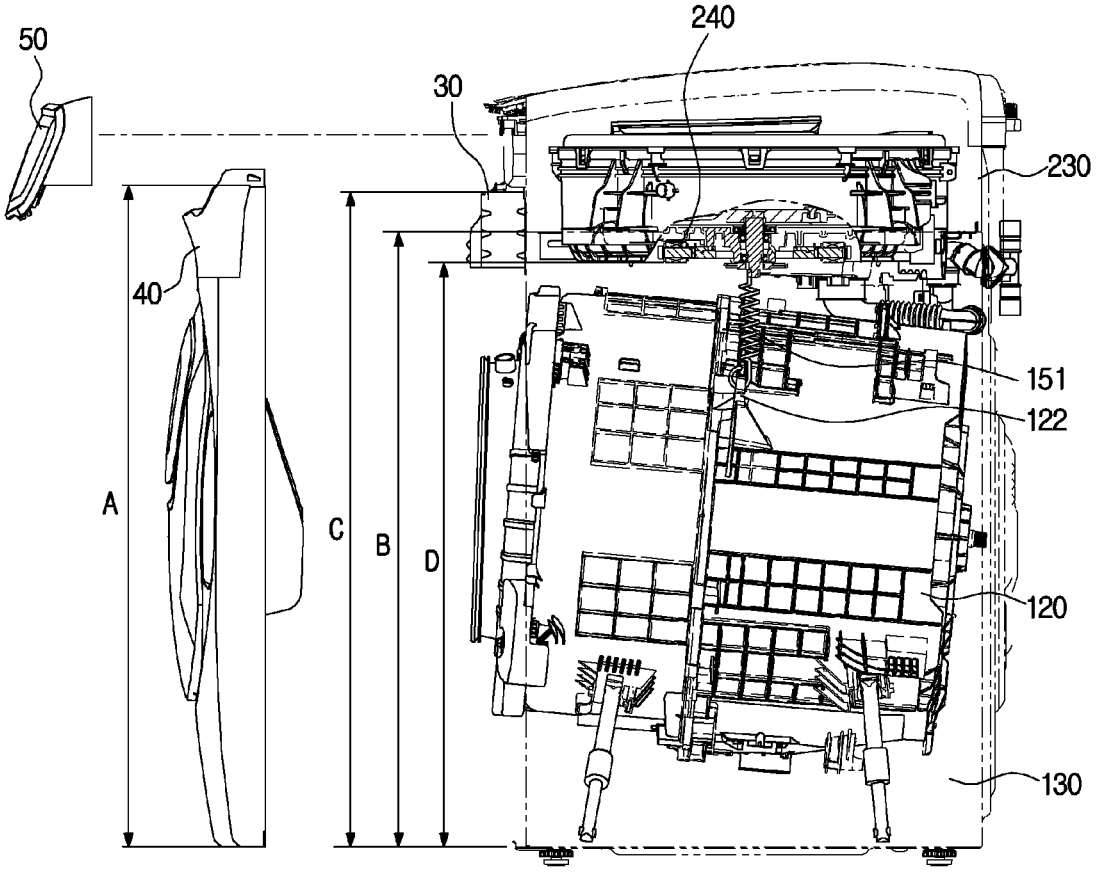
FIG. 7 is a side view illustrating a coupling position of the fixing bracket and the front cover of the washing machine shown in FIG. 2.

FIG. 4 is an exploded perspective view illustrating the second housing of the washing machine shown in FIG. 2. FIG. 5 is an enlarged view illustrating a part of the first housing of the washing machine shown in FIG. 2. FIG. 6 is an enlarged view illustrating parts of the fixing bracket and the front cover of the washing machine shown in FIG. 2. FIG. 7 is a side view illustrating a coupling position of the fixing bracket and the front cover of the washing machine shown in FIG. 2.

Referring to FIG. 4, the lower frame 231 of the second housing 230 may include a first supporter 238 provided to hold the suspending device 250. Also, the second tub 220 may include a second supporter 221 at a bottom of an outer surface thereof, on which the suspending device 250 is mountable. The suspending device 250 may be configured to connect the first supporter 238 of the lower frame 231 to the second supporter 221 of the second tub 220.

Because a front wall 298, a rear wall 297, and a pair of side walls 296 may be connected to surround a front, a rear, and sides of the second tub 220 and the first supporter 238 may be provided at a top end of each corner, the lower frame 231 may have adequate rigidity capable of supporting the second tub 220 using four suspending devices 250.

The upper frame 232 may include a first coupler 235 capable of being coupled to the lower frame 231. The first coupler 235 may be disposed at bottom ends of left and right sides of the upper frame 232. The lower frame 231 may include a second coupler 237 capable of being coupled to the upper frame 232. The second coupler 237 may be disposed at a position corresponding to the first coupler 235 of the upper frame 232 of a top end of the lower frame 231.

The side cover 233 may be coupled to the upper frame 232 and the lower frame 231 to cover a side surface of the upper frame 232 and a side surface of the lower frame 231. The side cover 233 may include a top end flange 293 capable of being coupled to the upper frame 232, and the upper frame 232 may include a coupling groove 236 into which the top end flange 293 of the side cover 233 is insertable. A fastener 239 capable of being coupled to the upper frame 232 in the coupling groove 236 of the upper frame 232 may be provided at the top end flange 293 of the side cover 233, and the fastener 239 may be coupled to the upper frame 232 by using a fastening member such as a screw and the like.

A bottom end flange 295 capable of surrounding a part of a bottom surface of the lower frame 231 may be provided at a bottom end of the side cover 233, and a rear end flange 294 capable of surrounding parts of rear surfaces of the upper frame 232 and the lower frame 231 may be provided at a rear end of the side cover 233.

After the lower frame 231 and the upper frame 232 are coupled, the top end flange 293 of the side cover 233 may be inserted into the coupling groove 236 of the upper frame 232, and the bottom end flange 295 of the side cover 233 may be rotated and coupled to be located at the bottom surface of the lower frame 231. After the side cover 233 is coupled, the rear end flange 294 of the side cover 233 may be fixed to the rear surfaces of the upper frame 232 and the lower frame 231 by using a fastening member such as a screw and the like.

The lower frame 231 may generate vibrations due to the second tub 220 supported to the lower frame 231. Also, the vibrations of the lower frame 231 may be transferred to the upper frame 232 by coupling between the lower frame 231 and the upper frame 232.

When the lower frame 231 and the upper frame 232 are disassembled by the vibrations and the like, the side cover 233 may prevent a consumer from being hurt, by restraining the lower frame 231 and the upper frame 232 from being randomly separated. Also, the side cover 233 may simplify side surfaces of the second housing 230 by covering left side surfaces and right side surfaces of the lower frame 231 and the upper frame 232. When the second housing 230 is coupled to the first housing 130, the first housing 130 and the second housing 230 may be allowed to have unifying aesthetics.

Referring to FIGS. 4 and 6, the second housing 230 of the washing machine 1 may be defined as including a pair of second side panels 135 which form the side surfaces of the second housing 230. That is, a second side panel 135 of the second housing 230 may be configured as at least parts of the side walls 296 of the lower frame 231, side walls 299 of the upper frame 232, and the side cover 233.

Referring to FIG. 5, the washing machine 1 may include a first guide protrusion 290 disposed at a top end of the first housing 130 and configured to guide a mounting position of the second housing 230. In detail, the first guide protrusion 290 may be provided to protrude upward from the pair of first side panels 131. The first guide protrusion 290 may be formed as a separate member and be coupled to the first side panels 131 or may be integrated with the first side panels 131.

Referring to FIG. 4, the washing machine 1 may include a guide protrusion insertion portion disposed below the pair of second side panels 135 of the second housing 230 to insert the first guide protrusion 290. In detail, a through hole 292 through which the first guide protrusion 290 may pass may be provided at the bottom end flange 295 of the side cover 233, which forms the second side panel 135, and a guide protrusion accommodating portion 291 capable of accommodating the first guide protrusion 290 may be provided at a bottom surface of the side wall 296 of the lower frame 231, which forms the second side panel 135.

Four first guide protrusions 290 may be disposed at each of top ends of a left side and a right side of the first side panel 131 of the first housing 130 and may be aligned to prevent the side surfaces of the first housing 130 and the second housing 230 from having a step therebetween caused by the first guide protrusions 290.

Although not shown in the drawings, a guide protrusion which guides a mounting position of the second housing 230 may be provided to protrude downward from the pair of the second side panels 135 of the second housing 230, and a guide protrusion insertion portion into which the guide protrusion is inserted may be formed above the pair of first side panels 131 of the first housing 130.

Referring to FIGS. 6 and 7, the front cover 40 may be provided to cover at least part of a front surface of the first housing 130 and at least part of a front surface of the second housing 230. Although the front cover 40 is shown as covering the entire front surface of the first housing 130, the front cover 40 may be provided to cover a part of the front surface of the first housing 130 and a part of the front surface of the second housing 230.

The fixing bracket 30 may be disposed in the front cover 40 and may fix the first housing 130 to the second housing 230 in front of the first housing 130 and the second housing 230. In detail, the fixing bracket 30 may connect the pair of first side panels 131 of the first housing 130 and the pair of second side panels 135 of the second housing 230.

The fixing bracket 30 may have a length corresponding to lateral widths of the first housing 130 and the second housing 230 and may include a rectangular parallelepiped shape having a thickness corresponding to a thickness of the front cover 40. The fixing bracket 30 may be configured to have a front surface 34, a top surface 31, a left side surface, and a right side surface. Here, a rear surface and a bottom surface thereof are open.

The fixing bracket 30 may include a coupling flange 35 capable of being coupled to the front of the first housing 130 and the front of the second housing 230. In detail, the coupling flange 35 of the fixing bracket 30 may be coupled to front ends of the pair of first side panels 131 of the first housing 130 and front ends of the pair of second side panels 135 of the second housing 230 by fastening members such as screws and the like.

The fixing bracket 30 may include a second guide protrusion 32 provided at the top surface 31 of the fixing bracket 30 and capable of guiding a coupling position of the front cover 40. The front cover 40 may include a guide hole 43 provided at a top of the front cover 40 and to which the second guide protrusion 32 of the fixing bracket 30 is couplable.

Also, the fixing bracket 30 may include a third coupler 33 provided at the front surface 34 of the fixing bracket 30 and to which the front cover 40 is couplable. The front cover 40 may include a fourth coupler 44 provided at the top of the front cover 40 and corresponding to the third coupler 33 of the fixing bracket 30.

During a process of assembling the front cover 40, after the front cover 40 is temporarily coupled to the fixing bracket 30 to allow the second guide protrusion 32 of the fixing bracket 30 to pass through the guide hole 43 of the front cover 40, the third coupler 33 of the fixing bracket 30 and the fourth coupler 44 of the front cover 40 may be coupled by using a fastening member such as a screw and the like.

Referring to FIGS. 2 and 7, the first tub 120 may be supported by the spring 151 to the first housing 130. In detail, one end of the spring 151 is coupled to a first spring coupler 133 provided on a top of the first side panel 131 of the first housing 130, and the other end of the spring 151 may be coupled to a second spring coupler 122 formed on the outer surface of the first tub 120. The spring 151 may damp down vibrations and noises of the first tub 120, but the vibrations of the first tub 120 may be transferred to the first housing 130 by the spring 151.

Because the front cover 40 is disposed to allow a height A of a top end to be higher than a height B of the top end of the first housing 130 to which the spring 151 is coupled, strength for supporting a front surface of the washing machine 1 may be provided and vibrations of the first housing 130 and the second housing 230 may be effectively prevented from being transferred frontward. Also, the front surface of the washing machine 1 may include only the front cover 40 and the control panel 50 disposed at the top of the front cover 40 to provide an aesthetic effect.

The fixing bracket 30 may be disposed to allow a height C of a top end of the fixing bracket 30 to be equal to or higher than a height D of a top end of the second driving motor 240 disposed outside the bottom of the second tub 220. Because the fixing bracket 30 may include a fire-resistant material such as a metal and the like and be disposed above the second driving motor 240, if a fire occurs due to the overheated second driving motor 240, it is possible to prevent the fire from spreading toward the front cover 40 or the control panel 50.

As is apparent from the above description, a washing machine according to one embodiment of the present disclosure includes a plurality of washers to separate and wash laundry as necessary.

The washing machine may provide reinforced strength for fastening a first housing to a second housing by using a fixing bracket fixed to fronts of the first housing and the second housing.

The washing machine may provide stiffness for supporting a front surface of the washing machine by using a front cover provided to cover at least part of a front surface of the first housing and at least part of a front surface of the second housing and may effectively prevent vibrations of the first housing and the second housing from being transferred frontward.

The scope of the present disclosure is not limited to the particular embodiments described above. Various other embodiments correctable or modifiable by one of ordinary skill in the art within a range without departing from the essence as the technical concept of the present disclosure defined by the claims are also included in the scope of the present disclosure.

What is claimed is:

1. A washing machine comprising:

a first housing having an open top;

a first tub disposed in the first housing of the washing machine;

a second housing having an open bottom provided adjacent to the open top of the first housing;

a second tub disposed in the second housing;

a front cover provided to cover at least a portion of a front surface of the first housing and at least a portion of a front surface of the second housing; and a fixing bracket coupled to a front of the first housing and a front of the second housing to couple the first housing to the second housing, and configured to be coupled to a top end of the front cover.

2. The washing machine of claim 1, wherein the first tub includes a first opening in a front of the first tub, the first opening configured to receive laundry for the first tub, and the second tub includes a second opening in a top of the second tub, the second opening configured to receive laundry for the second tub.

3. The washing machine of claim 1, wherein the second housing further comprises:

a lower frame configured to support the second tub, and an upper frame disposed on the lower frame.

4. The washing machine of claim 3, wherein the second housing further comprises a side cover provided to cover a side surface of the upper frame and a side surface of the lower frame.

5. The washing machine of claim 3, further comprising a suspending device configured to support the second tub on the lower frame.

6. The washing machine of claim 5, wherein the lower frame surrounds the second tub, and comprises a first supporter configured to support the suspending device.

7. The washing machine of claim 6, wherein the second tub comprises a second supporter on which the suspending device is mountable, and wherein the suspending device is configured to connect the first supporter to the second supporter.

8. The washing machine of claim 1, further comprising:

a guide protrusion which protrudes upward from a top of the first housing; and a guide protrusion insertion portion disposed in a bottom of the second housing to receive the guide protrusion.

9. The washing machine of claim 1, further comprising:

a guide protrusion which protrudes downward from the second housing; and a guide protrusion insertion portion disposed in a top of the first housing to receive the guide protrusion.

10. The washing machine of claim 1, wherein the fixing bracket is directly coupled to the top end of the front cover.

11. The washing machine of claim 1, wherein the fixing bracket comprises a guide protrusion configured to guide the front cover into a coupling position, and the front cover comprises a guide hole configured to receive the guide protrusion of the fixing bracket.

12. The washing machine of claim 1, wherein the fixing bracket comprises a first coupler to which the front cover is fixable, and the front cover comprises a second coupler which is fixable to the fixing bracket.

13. A washing machine comprising:

a first housing configured to house a front-loading tub;

a second housing disposed adjacent to the first housing and configured to house a top-loading tub;

a front cover provided to cover at least a portion of a front surface of the first housing and at least a portion of a front surface of the second housing of the washing machine; and a fixing bracket coupled to a front of the first housing and a front of the second housing to couple the first housing to the second housing, and configured to be coupled to a top end of the front cover.

14. The washing machine of claim 13, wherein the fixing bracket is disposed inside the front cover.

15. The washing machine of claim 14, wherein a top end of the fixing bracket is directly coupled to the top end of the front cover.

16. The washing machine of claim 13, further comprising:

a spring configured to support the front-loading tub to the first housing, wherein the spring is configured to connect an outer surface of the front-loading tub to a top of the first housing.

17. The washing machine of claim 13, wherein a height of athe top end of the front cover is higher than a height of a top end of the first housing.

18. The washing machine of claim 14, wherein the fixing bracket is formed in a rectangular parallelepiped shape having a length corresponding to a lateral width of the first housing and the second housing and a thickness corresponding to a thickness of the front cover, and has an open rear surface and an open bottom surface.

19. The washing machine of claim 13, further comprising:

a drum disposed to be rotatable in the top-loading tub, and a driving motor configured to rotate the drum, wherein a height of the top end of the fixing bracket is equal to or higher than a height of a top end of the driving motor.

20. A washing machine comprising:

a front side;

a top side;

a bottom side;

a first housing having a top opening facing the top side of the washing machine and a front opening facing the front side of the washing machine;

a front-loading tub disposed in the first housing of the washing machine and having a front-loading tub opening corresponding to the front opening of the first housing;

a second housing having a bottom opening facing the bottom side of the washing machine and a top opening facing the top side of the washing machine, the second housing provided above and coupled to the first housing such that the top opening of the first housing is provided adjacent to the bottom opening of the second housing;

a top-loading tub disposed in the second housing of the washing machine and having a top-loading tub opening corresponding to the top opening of the second housing;

a front cover provided to cover at least a portion of a front surface of the first housing and at least a portion of a front surface of the second housing; and a fixing bracket coupled to a front side of the first housing and a front side of the second housing to couple the first housing to the second housing, and configured to be coupled to a top end of the front cover.

* * * * *